US008025432B2

(12) United States Patent
Wainright

(10) Patent No.: US 8,025,432 B2
(45) Date of Patent: Sep. 27, 2011

(54) HELMET LED LIGHTING SYSTEM

(76) Inventor: Lee Wainright, Bethlehem, PA (US)

( * ) Notice: Subject to any disclaimer, the term of this patent is extended or adjusted under 35 U.S.C. 154(b) by 207 days.

(21) Appl. No.: 12/283,411

(22) Filed: Sep. 10, 2008

(65) Prior Publication Data

US 2009/0073679 A1 Mar. 19, 2009

Related U.S. Application Data

(60) Provisional application No. 60/993,368, filed on Sep. 13, 2007.

(51) Int. Cl.
*F21V 23/04* (2006.01)

(52) U.S. Cl. ... 362/394; 362/106; 362/191; 362/249.04; 362/249.05; 362/398

(58) Field of Classification Search ..... 362/105, 362/106, 191, 249.04, 249.05, 394, 398
See application file for complete search history.

(56) References Cited

U.S. PATENT DOCUMENTS

| | | | | |
|---|---|---|---|---|
| 4,092,704 | A | 5/1978 | Malm | |
| 4,199,802 | A | 4/1980 | Malm | |
| 4,559,516 | A | 12/1985 | Schott et al. | |
| 4,769,629 | A | 9/1988 | Tigwell | |
| 4,793,007 | A | 12/1988 | Barnett | |
| 4,901,210 | A | 2/1990 | Hanabusa | |
| 5,040,099 | A | 8/1991 | Harris | |
| 5,128,844 | A | 7/1992 | Landais | |
| 5,327,588 | A | 7/1994 | Garneau | |
| 5,329,637 | A | 7/1994 | Walker | |
| 5,408,393 | A | 4/1995 | Becker | |
| 5,743,621 | A | 4/1998 | Mantha et al. | |
| 5,910,764 | A | 6/1999 | Hayden | |
| 6,244,721 | B1 | 6/2001 | Rodriguez et al. | |
| 6,373,675 | B1 * | 4/2002 | Yamazaki et al. | 361/135 |
| 6,406,168 | B1 | 6/2002 | Whiting | |
| 6,439,733 | B1 | 8/2002 | Fischer et al. | |
| 6,497,493 | B1 | 12/2002 | Theisen | |
| 6,648,489 | B2 | 11/2003 | Fischer et al. | |
| 6,784,795 | B1 | 8/2004 | Pories et al. | |
| 6,982,633 | B2 | 1/2006 | Burdick | |
| 7,109,857 | B2 | 9/2006 | Ross, Jr. et al. | |
| 7,221,263 | B2 | 5/2007 | Moore et al. | |

* cited by examiner

*Primary Examiner* — Stephen F Husar
*Assistant Examiner* — James W Cranson
(74) *Attorney, Agent, or Firm* — Feldman Law Group; Stephen E. Feldman

(57) ABSTRACT

This invention relates to a miniature, battery operated, air tight light emitting module having a LED/LEDS that projects at least two different frequencies of light energy. The LEDs are mounted in a protective air-tight shell. The LEDs are activated by a magnetic field of associated magnetic rings. The attachment mechanism to hold the module(s) to safety hard hats and helmets consists of an elastic band allowing a module or series of modules to be attached to the exterior surface of various types of helmets.

20 Claims, 7 Drawing Sheets

HELMET LED LIGHTING SYSTEM

RELATED APPLICATIONS

This application claims the priority of U.S. Provisional Application No. 60/993,368, filed Sep. 13, 2007.

BACKGROUND OF THE INVENTION

1. Field of the Invention

The invention relates to light emitting systems for helmets, and more particularly, to light emitting systems with LED modules for helmets.

2. Description of the Prior Art

Various attempts have been made in the art to provide lighting equipments that are useful in low light or no light environment. The lighting devices in the art generally include hardware that is mounted on the helmet. Moore et al., (U.S. Pat. No. 7,221,263) teaches a bicycle or motorcycle helmet that uses accelerometers to activate multiple arrays of LEDs that require high amounts of current for the light output.

The prior art also includes helmets with LED lights that are designed to act as an indicator to give various signals, for example, a brake signal, turn signal, or strobe positioning lights. These devices generally include a plurality of auxiliary components and fixed mechanisms to hold them to helmet surfaces as well as mechanisms to activate them remotely.

The helmets lighting systems in the prior art generally require additional mounting hardware to affix the lighting system to helmets. Such systems are preferred in a mining safety or other applications requiring no additional fixture attachments to helmets. A plurality of physical switches mounted on exterior battery cases are a big concern for electronic failure, water damage, and opens the potential for batteries to dislodge and short causing sparks which could ignite flammable gasses.

Burdick, (U.S. Pat. No. 6,982,633) teaches a motorcycle helmet having a ring of lights with a battery is mounted around the entire circumference of the helmet. However, this system is not suitable for various sized helmets, and in addition, requires substantial energy to keep it lighted continuously for a week or more without heavy batteries which would make it unwieldy to mount on a helmet.

Rodriguez et al. (U.S. Pat. No. 6,244,721) and Hanabusa, (U.S. Pat. No. 4,901,210) use a band holding exposed LEDs connected to the helmet with wires connecting to a battery mounted inside or outside of the helmet. The LEDs are powered by an open coin cell battery holder mounted on the rear of the helmet. Both methods include exposed connections and batteries to the air, which is most undesirable in explosive gas environments due to spark potential. Furthermore, these LEDs light the peripheral areas rather than lighting the area directly in front of an observer.

The helmet lighting systems in the prior art generally have large power consumption, bulky mounting mechanisms, user unfriendliness, and are fragile. Such helmet lighting systems have not been acceptable for use in the mining safety industry or underground construction sites. There are several areas where light is needed for utility functions for the wearers themselves. Prior art devices that address utility light output on helmets generally include heavy batteries and exposed wiring connections that may represent a spark hazard in potential explosive gas environments.

The prior art include lighting systems for safety apparel that use Electro-luminescence (EL) strips sewn into the fabric surfaces to blink on and off. In such lighting systems several "AA" batteries to activate the blinking of the strips are used. It is observed that such systems are prone to breakage, are very dim to view at even moderate distances, and contain wiring prone to breakage that must run the entire length of the EL strip. EL has no IR energy output frequency so is not used with FLIR equipment and it requires wires to run the full length of the light output putting dangerous conductive surfaces near the heart and chest areas of workers.

In order to light up surface areas of items such as clothing or backpacks, suitcases, exterior portions of transport vehicles, and the like, incandescent lights, LEDs, or EL are employed in the prior art. However, the extensive wiring and high current draw that reduces the battery life make these lighting systems unsuitable for mining and hazardous operating conditions. Safety jackets presently used by airlines are made with a flashing beacon attached that activates upon contact with water. It is observed that the lifespan of such devices is quite short (measured in hours) because they have no way of shutting them off. Furthermore, they do not contain IR output for long distance detection from aircraft. The prior art safety helmet lighting systems fail to assist search and rescue personnel in locating distressed or injured workers in dust-filled, fog-like, or inclement conditions that prevents visible light from penetrating. Emergency circumstances such as explosions, cave-ins, dense fog, smoke from fires, etc. can prevent light from penetrating the opaque air-borne conditions, thus, preventing rescuers from finding people quickly in need of immediate assistance.

A lighting system having light weight batteries is needed that provides light for extended periods of time and that allows others around to identify the position and orientation of the user. A lighting system is further needed that is intrinsically safe for use in potentially explosive gaseous environments and that is flexible to mount on safety helmets of various sizes.

SUMMARY OF THE INVENTION

Figure 1:
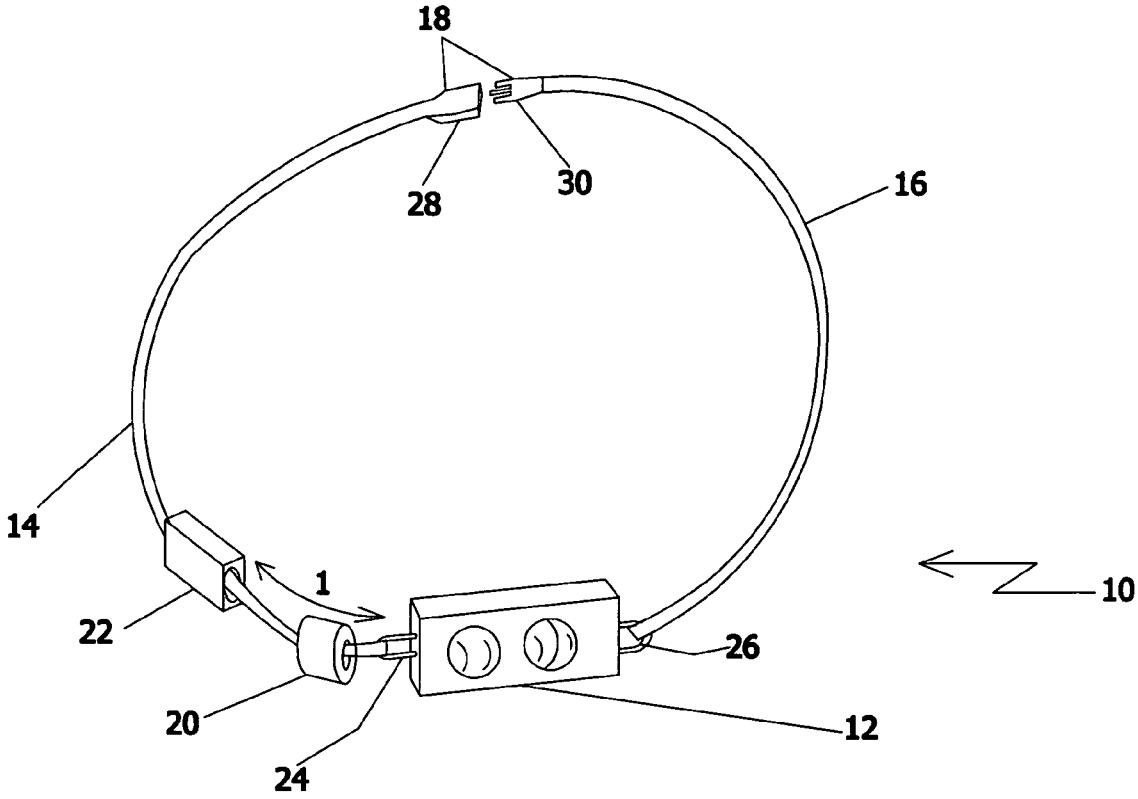
FIG. 1 is a front perspective of a preferred embodiment of a LED lighting system of the present invention.

A LED lighting system for emitting visible and invisible energy frequencies in low visibility and hazardous environments having a predefined object with an exterior surface, an elastic band attached to the exterior surface of the object, a LED module connected to the elastic band for emitting infra red and visible light in low visibility and hazardous environments is provided.

Each of the LED modules includes a shell that is securely mounted on a base plate preferably with a gasket. The body of the shell also includes at least one pair of LEDs. The module includes a quiescent circuit, a magnetic reed switch and at least one coin cell. In a preferred embodiment of the present invention the module is coupled with a first band and a second band. The second band includes a snap attachment to open and close the band around an object.

In another embodiment of the present invention, the LED light emitting system includes a pair of modules that are coupled with a pair of elastic bands. The first module has a first end and a second end so that the first end includes a first loop and a second end includes a second loop. The second module has a first end with a first loop and a second with a second loop. A first end of a first band is coupled with the second loop of the first module. A second end of the first band is coupled with the first loop of the second module. A first end of a second band is coupled with the first loop of the first module and a second end of the second band is coupled with the second loop of the second module.

Each of the magnetic rings is in close proximity to the magnetic reed switch of the respective module in the first position of the magnetic ring. In the first position, the magnetic ring is in close proximity with the reed switch that closes the electronic circuit to switch on the respective LEDs of the module. The magnetic ring is moved away from the reed switch of the respective module in the second position to open the reed switch and shut off the respective LEDs.

In another alternative embodiment of the present invention, the LED lighting system includes at least two pairs of LED modules that are coupled with at least two pairs of flexible bands. Each of the LED modules has an associated magnetic ring and a stopper. A first pair of modules and second pair of modules are approximately symmetrically positioned with respect to a vertical axis-YY. A first and a second module of the first pair include at least two white LEDs each. A third and a fourth module of the second pair of modules includes at least one color LED and one IR diode each.

A stopper is associated with each of the modules. The stopper advantageously restricts the motion of the respective rings along a predefined path on the band. The lighting system of the present invention is mountable on helmets, poles or similar objects of various sizes and with the elastic flexible bands. The white LEDs emit continuous white light to light up surrounding areas. A plurality of color LEDs are used to distinguish the rank of people working in dark areas. The packed electronics in the shell of the module reduces the possibility of accidents due to electric spark in hazardous environment.

DETAILED DESCRIPTION OF THE INVENTION

Although specific terms are used in the following description for sake of clarity, these terms are intended to refer only to particular structure of the invention selected for illustration in the drawings, and are not intended to define or limit the scope of the invention.

Referring to FIG. 1, a LED lighting system in accordance with an embodiment of the present invention is shown. The LED lighting system 10 includes a LED module 12, a first band 14, a second band 16 and a snap attachment 18. A magnetic ring 20 and a stopper 22 that are associated with the LED module 12 are preferably positioned on first band 14. The magnetic ring 20 is movable between the module 12 and the stopper 22 along the first band 14 as indicated by arrow 1. Bands 14 and 16 are preferably flexible at least in part and preferably made of elastic material. The LED light emitting system 10 has a closed configuration and an open configuration.

The module 12 includes a pair of opposed loops that are mounted on opposed ends of the LED module 12. First band 14 is coupled to module 12 with a first loop 24 and second band 16 is coupled to module 12 with a second loop 26. The ends of the bands 14 and 16 are removably coupled with the snap attachment 18. A free end of first band 14 includes a female part 28 of the attachment 18 and a free end of the second band 16 includes a male part 30 of the attachment 18. The male part 30 is inserted in the female part 28 with a snap fit to close the attachment 18 to define the close configuration of the LED light emitting system. The snap attachment is opened by pressing a trigger on the male part 30 to open the LED light emitting system 10. It is, however, understood that connecting mechanisms, for example, a riveted snaps, Velcro, magnetic coupling can also be employed instead of the snap attachment 18.

Figure 2:
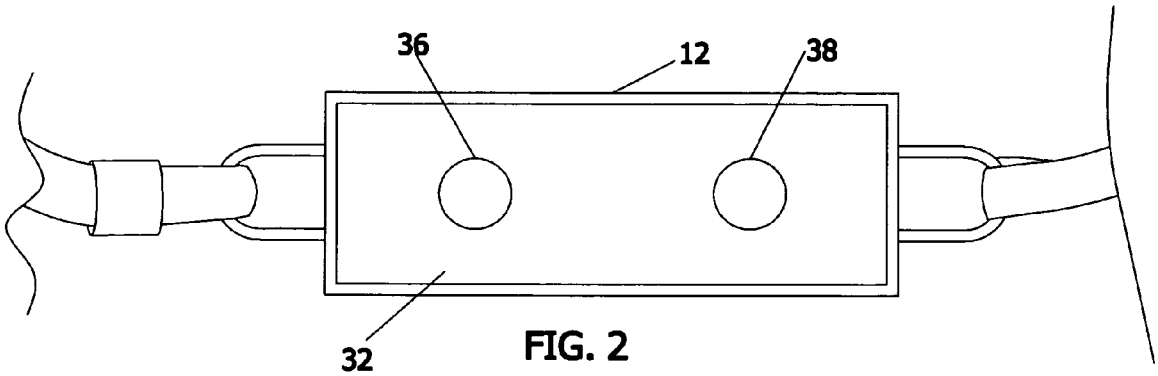
FIG. 2 is a top view of a module of the LED lighting system of FIG. 1.
Figure 3:
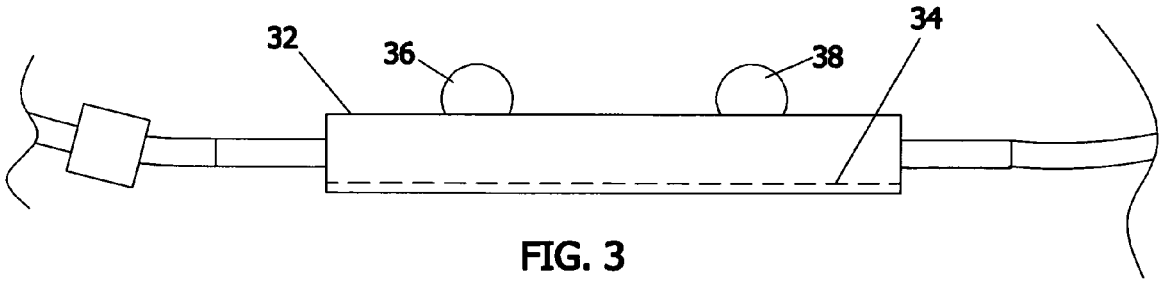
FIG. 3 is a side view of the module of FIG. 2.

Referring to FIGS. 2 and 3, the LED light utility module 12 in accordance with a preferred embodiment of the present invention is described. The LED module 12 includes a box shaped shell 32 that is securely mounted on an approximately rectangular base plate 34. It is, however, understood that the shell 32 of round, oval, and other shapes are also contemplated. The shell 32 is preferably made of plastic material. A rubber gasket is preferably positioned between the shell 32 and the base plate 34. The base plate 34 is preferably made of plastic material. Each light module is removable from a series of attachable modules that are connected with one or more module/modules with elastic bands.

The module 12 is a completely sealed with a non-replaceable type battery. The module 12 also includes associated electronic arrangement that is positioned on the base plate 34 to operate the LEDs. The covering shell 32 has a pair of plastic lensed light emitting diodes (LEDs). A first LED 36 emits visible light preferably constantly in a predetermined color and a second LED 38 intermittently blinks to emit IR energy. The IR LEDs blinks when the power is on.

Figure 4:
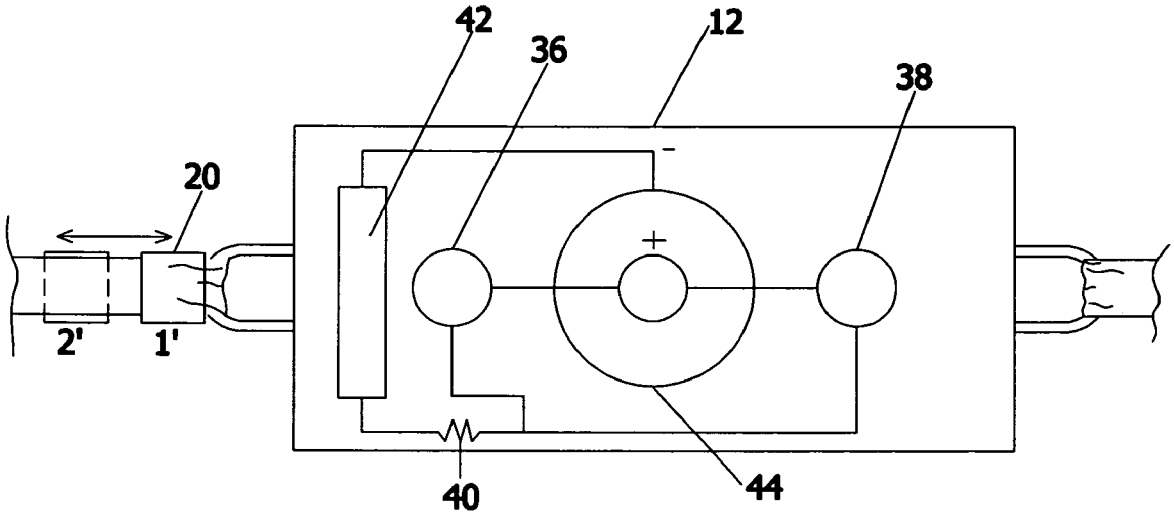
FIG. 4 is a top view of the module of FIG. 2 that shows the electronics of the module.

As shown in FIG. 4, the module 12 includes a quiescent circuit 40, a magnetic reed switch 42 and a coin cell 44. The quiescent circuit 40 includes current lowering resistors. The magnetic reed switch 42 is preferably a tiny glass sealed vacuum that is approximately (2 mm×10 mm) in size. The sealed vacuum of the reed switch 42 encloses magnetic contacts that close when any magnetic field is brought in close proximity with the reed switch 42. A magnetic field is used to activate the LEDs inside the sealed unit of the module 12.

The magnetic ring 20 has a first position and a second position as indicated by the arrow 1'-2'. In the first position, magnetic ring 20 is in close proximity to the magnetic reed switch 42 and the magnetic ring 20 is away from the reed 42 switch in the second position. In the first position, the circuit is closed to allow the power from coin cell 44 to flow from a negative terminal to the two LEDs 36 and 38 and thereby returning to the positive terminal on the coin cell(s) 44 through the reed switch 42 and a quiescent circuit 40.

The magnetic ring 20 is moved to the second position to turn off the LEDs 36 and 38 in the module 12. The second position is achieved by moving the magnetic ring 20 away from the side of the module 22, thus, removing the magnetic field necessary to keep the reed switch 42 closed. In the second position the reed switch 42 opens and the LEDs 36 and 38 shut off.

In another alternative embodiment of the light emitting system 10, the module 12 includes only one cord or band and snap attachment 18. The continuous cord is threaded through the first loop 24 of the module 12 and the cord exits through the second loop 26 of the module 12 continuing to the snap attachment 18. The module 12 also includes a hook and loop type Velcro self-stick removable piece on an outer surface of base plate 34. The self stick attachment is well known in the art. The self stick attachment advantageously allows sticking the module 12 to a desired object.

Figure 5:
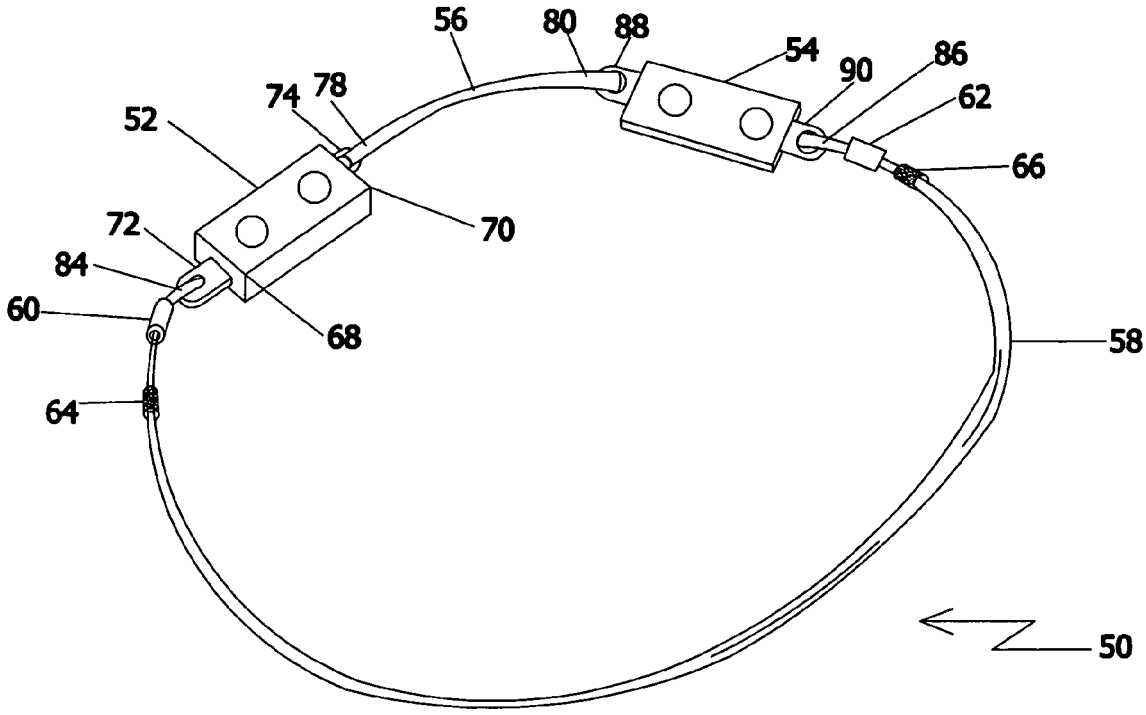
FIG. 5 is a top perspective of another alternative embodiment of LED lighting system of FIG. 1 with two modules.

Now referring to FIG. 5, another alternative embodiment of the LED light emitting system 10 in accordance with the present invention is shown. In this one embodiment, the LED system 50 includes a first LED module 52, a second LED module 54, a first band 56 and a second band 58. A first magnetic ring 60 is associated with first module 52 and a second magnetic ring 62 is associated with second module 54. In one embodiment, each of magnetic rings 60 and 62 are movable along band 58. A first stopper 64 and a second stopper 66 are also positioned near respective magnetic rings 60 and 62 on the second band 58.

The first LED module 52 has a first end 68 and a second end 70. First end 68 includes a first loop 72 and the second end 70 includes a second loop 74. First band 56 having a first end 78 and a second end 80, and the second band 58 with a first end 84 and a second end 86 are coupled with the modules 52 and 54 to define the lighting system 50 of the present invention. The band 58 is preferably made of elastic material to allow adjustment while mounding the system 50 on a desired object.

The first end 78 of the first band 56 is coupled with second loop 74 of the first module 52, and the second end 80 of the first band 56 is coupled with the first loop 88 of the second module 54. The first end 84 of the second band 58 is coupled with first loop 72 of the first module 52, and the second end 86 of the second band 58 is coupled with the second loop 90 of the second module 54. The length of the second band 58 is approximately four times the length of first band 56. The length of the first band 56 is approximately 5" and the length of the second band 58 is approximately 20". It is, however, understood that the lengths of the bands may vary with the application.

Figure 6:
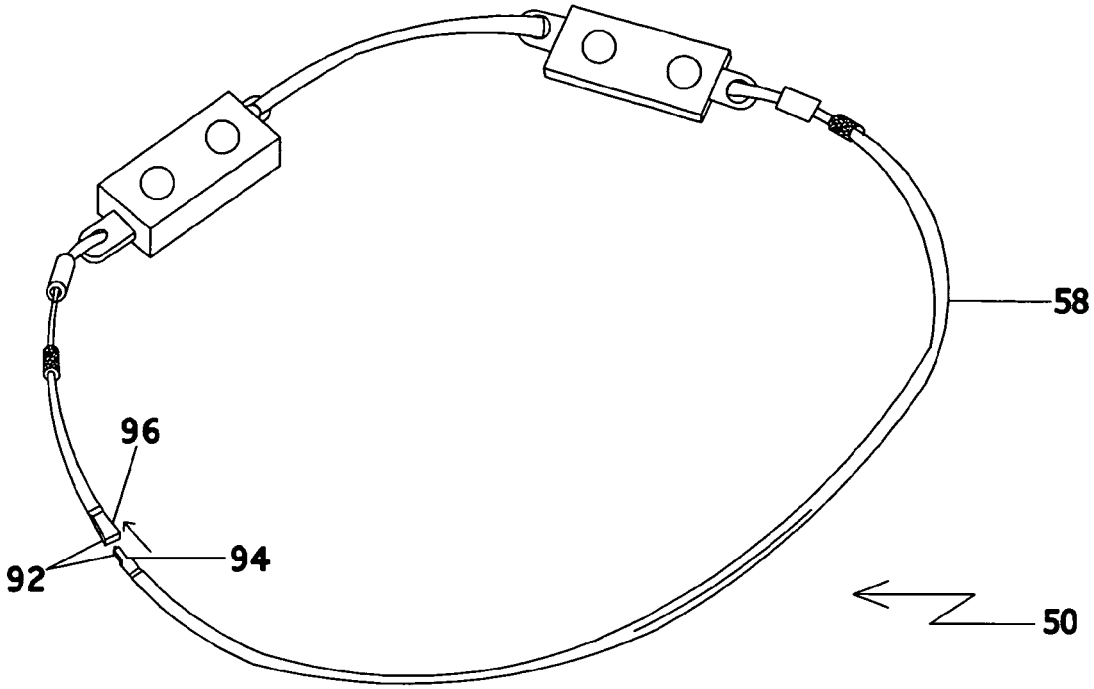
FIG. 6 is a top perspective of another embodiment of LED lighting system of FIG. 5.

Referring to FIG. 6, in another embodiment of the LED light emitting system 50, the second band 58 includes a snap attachment 92 that is adapted to facilitate mounting and removal of the LED light emitting system 50 on an object, such as, a helmet or a pole. The snap attachment 92 divides the second band 58 into two parts. The two parts are removably connected to open and close the band 58. The snap attachment 92 has a male part 94 and female part 96. The male part 94 and female part 96 are snap-fitted to close the band 58. The system 50 is preferably positioned on a desired object and then the band 58 is closed with the snap attachment 92. The snap attachment is opened to remove the band 58, thereby, removing the LED lighting system 50.

Figure 7:
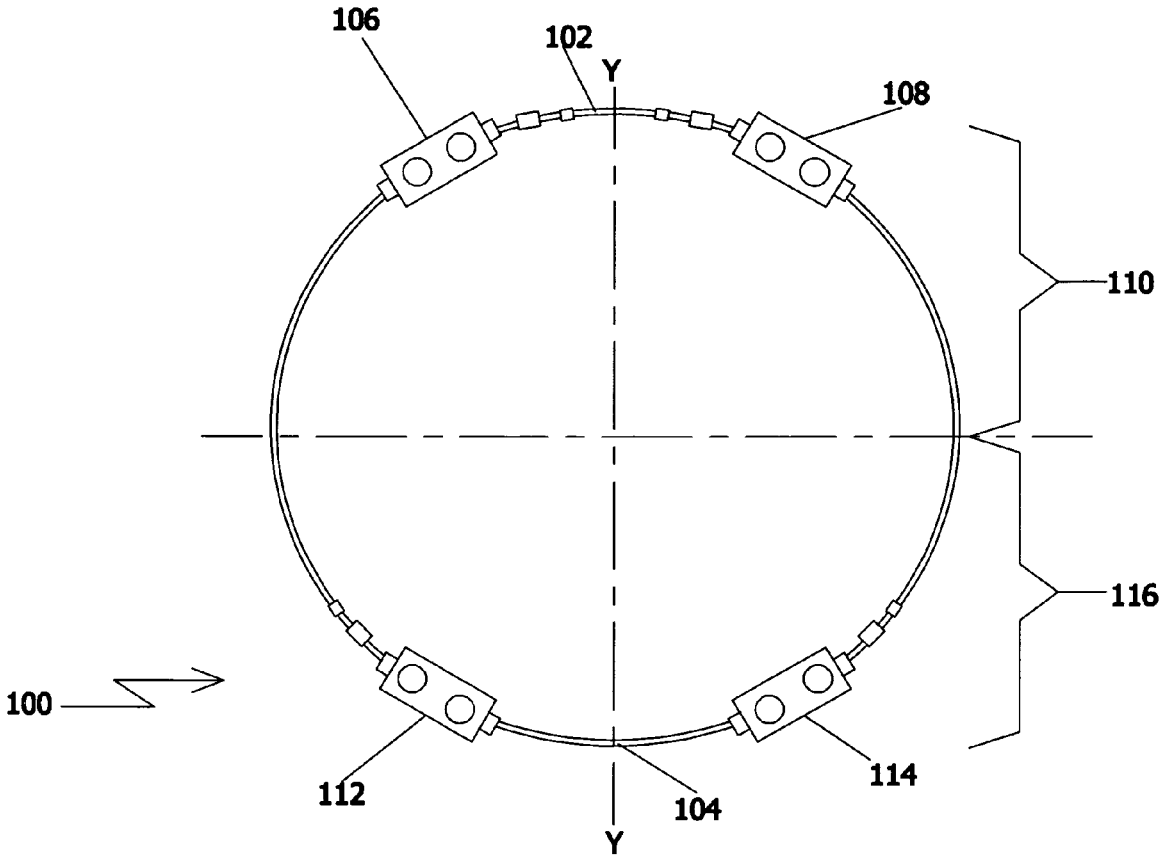
FIG. 7 is a top view of another embodiment of the LED light emitting system of FIG. 1 with four modules.
Figure 8:
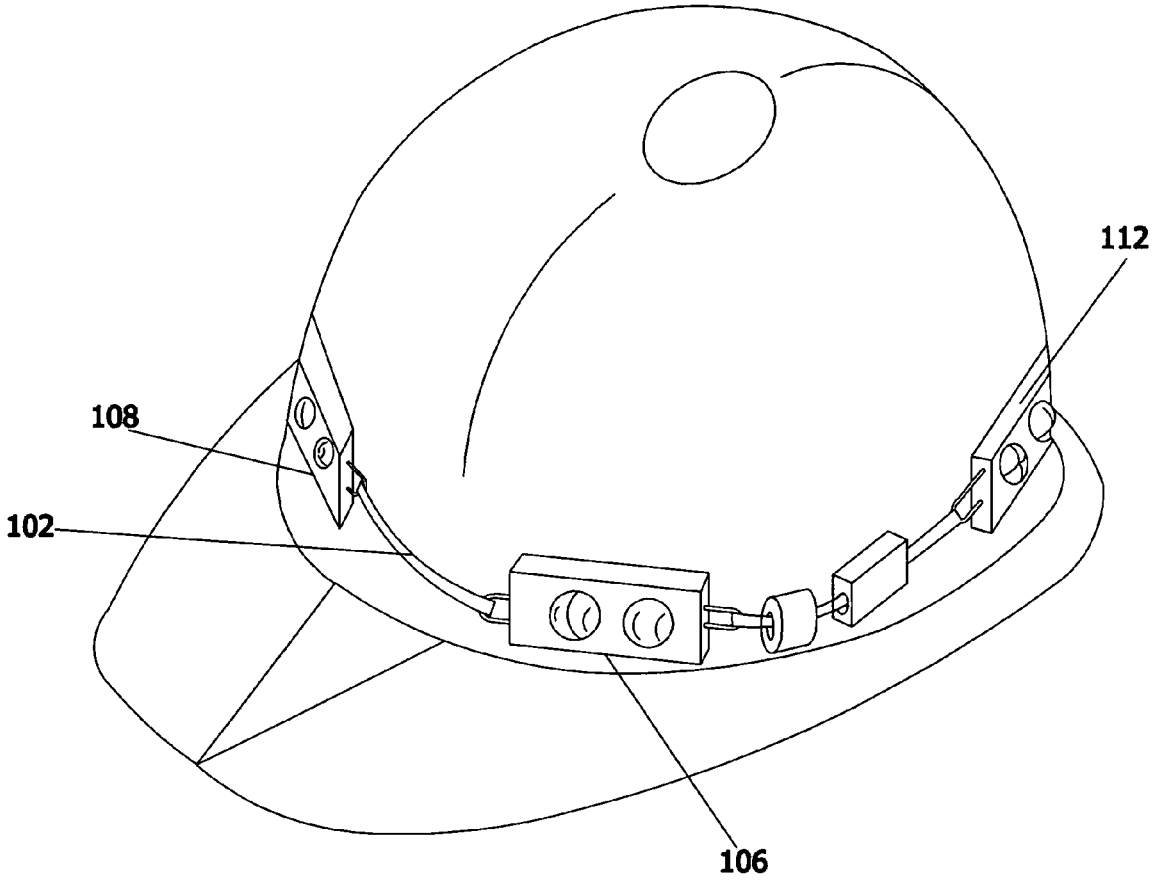
FIG. 8 is a top perspective view of the LED lighting system of FIG. 7 mounted on the helmet.

Now referring to FIGS. 7 and 8, another embodiment of the lighting system in accordance with the present invention is shown. In this one embodiment, the lighting system 100 includes at least two pairs of LED modules coupled with at least two pairs of flexible bands. In the light emitting system 100, each module snaps or attaches to successive module to form a light emitting rope in various frequencies dependent upon which modules are snapped together.

The lighting system 100 has a first end 102 and a second end 104. A first pair of modules includes a first module 106 and a second module 108. Modules 106 and 108 define a first portion 110 of the LED lighting system 100 along with respective magnetic rings and stoppers. Modules 106 and 108 are approximately symmetrically positioned in the LED lighting system 100 with respect to a vertical axis-YY. Modules 106 and 108 are approximately equidistant from the first end 102. Each of the modules 106 and 108 preferably include two white LEDs.

A second pair of modules includes a third module 112 and a forth module 114. Modules 112 and 114 define a second portion 116 of the LED lighting system 100 along with respective magnetic rings and stoppers. Modules 112 and 114 are approximately symmetrically positioned in the LED lighting system 100 with respect to vertical axis-YY. Modules 112 and 114 are approximately equidistant from the second end 104. Each of the modules 112 and 114 preferably respectively include a color LED and an IR diode.

Now referring to FIGS. 1 to 8, the lighting system 10 of the present invention is mounted on an object such as a helmet preferably on a bottom ring of the helmet. The light emitting system 10 is attached to the exterior surface of various types of helmets by pulling the unit over the exterior surface to the surrounding brim or base of the helmet. The self stick removable Velcro attachment advantageously helps to position the module 12 to any desired object. The self sticking attachment prevents the module 12 from drifting due to a shock.

Modules are removable to allow for independent operation. The modules are removed by uncoupling the loops from the respective bands. Each of the modules is advantageously detachable from the other modules of the light emitting system 10. The detached module is an independent light source for other applications. The stand alone module is attachable to a desired object preferably with an attaching means, for example, Velcro strips, two-way adhesive strips etc.

The flexible elastic bands securely hold the system on the body of the helmet. A user positions the system 10 according to the requirement on the helmet. In the first position, the LEDs are on to emit respective light. The lighting system 10 is deactivated by moving the magnetic ring 20 from the first position to the second position. In the first position, the magnetic field of ring 20 activates the magnetic reed switch 42 to blink the LEDs. LEDs 36 and 38 can be switched off by moving the magnetic ring 20 to the second position.

The stoppers 22 associated with each of the modules 12 advantageously prevent the motion of the respective rings 20 beyond the position of the stopper 22 on the band 14. The lighting system 10 of the present invention easily adapts to helmets of various sizes and configurations without need of any mounting hardware. The electronic circuitry and the batteries are completely encased in air-tight body shell 32 without any exposed wires, connections, batteries, or switches.

Two frequencies of Infrared band and visible light are preferably emitted by the light emitting system 10 of the present invention. The first IR frequency is approximately in a range of 850 nm.-1200 nm. that is invisible to the naked eye. The second visible frequency is in the visible light spectrum. The LEDs 36 and 38 emit special visible and invisible energy frequencies that penetrate opaque materials such as dust and fog so rescuers can find distressed and injured people quickly in adverse visibility environments. The LED lighting system 10 is mountable on various objects to increase their visibility as well as low-profile to prevent accidental impact with external objects.

The light emitting system 10 of the present invention preferably includes two small coin cells 44 powering multiple light emitting diodes (LEDs) 36 and 38 connected to a current reducing resistor 40 and a magnetic reed style switch 42 for activation. The module 12 preferably includes multiple LEDs giving off visible white light energy and/or LEDs giving off IR energy or a combination of both white light and IR LEDs. By employing LEDs emitting continuous white light, the visible energy is projected outward away from the user for utility use to light up surrounding areas and is visible to surrounding workers.

Various colors and combinations of LEDs may be incorporated into the light emitting system 10 for attachment to helmets. For example, a yellow LED color output module may be placed on the rear of the elastic band to signify to surrounding workers the orientation position of fellow workers in pitch black environments such as is found in mines. Other colors may signify and distinguish the rank of people working in dark areas between engineers, construction, medical, and safety personnel.

The system 10 of the present invention is safe enough to avoid accidents in hazardous environment. The electronic and electrical components are not in contact with surrounding air due to the shell 32. No spark hazard can exist where a possible shorting of contacts could accidentally set off an explosion. The use of magnetic ring 20 and reed switch 42 eliminates possibility of electric spark.

The shell 32 is made of non-conductive compound. The shell 32 encapsulates the interior portion of the module preferably through an airtight rubber gasket. The shell 32 and base plate 34 arrangements in the module makes the module robust. The system 10 can withstand high impact, hostile weather and extreme environmental conditions including under water, chemical and physical abrasiveness, and is not prone to connection failures due to extreme temperature changes.

LED light module 12 is removable from a series of attachable modules to adjust according to the size of an object on which it is being mounted. The elastic band also adds flexibility of mounting on objects of various sizes to the LED light system 10. The light modules 12 can be coupled with other light modules of different LED light to form a light emitting rope using the method described above.

The IR LEDs 38 conserve energy by blinking on and off. IR LEDs are not able to be seen with normal eye and do not offer any distraction by blinking on and off. The IR blinking LED 38 is preferably replaceable with a RED LED to increase visibility. The system is attachable to a helmet worn by miners or construction workers. Although the IR LED 38 cannot be seen without use of special detection equipment, it is designed to blink a high intensity flash in the IR frequency spectrum to allow searchers/rescuers/emergency personnel to locate the device through environments such as dust-filled, smoke laden, blizzard, and other conditions that make it impossible to see normal light in the visible spectrum with the naked eye.

In more adverse conditions where smoke and dust prevail such as in a coal mine, the pulsing IR diode 38 acts like a beacon in the fog penetrating opaque materials to be detected using special FLIR (Forward Looking Infrared) equipment such as the type used in the military for night vision exercises.

A lighting system 50 with two pairs of modules on the helmet worn by miners offers an advantage of peripheral vision lighting, and additional orientation positioning for other miners to observe. The smaller diameter light output penetrates through fog and smoke far more efficiently than brighter reflective lensed type lights used for miner helmets. The small diameter LEDs 36 and 38 are easily seen through fog as single points of light therefore the positions of the people wearing them are easily determined.

The lighting system 10 of the present invention requires extremely low current draw. Gasket positioned in between the shell 32 and the base plate 34 advantageously makes the system 10 a waterproof system. The system 10 does not require external switches to activate and deactivate the LED lights. The light emitting LED system is tiny enough to be mounted on, such as, for example, a belt pack, vest, backpack, jacket, duffel bag, raincoat, safety vest. The light emitting LED system 10 is intended for use with fireman waterproof coats, DOT safety vests, police and emergency worker vests, electrical workers, linemen, as well as duffel bags, securing straps for transport vehicles, sails, belt packs, and back packs.

The embodiments of the invention shown and discussed herein are merely illustrative of modes of application of the present invention. Reference to details in this discussion is not intended to limit the scope of the claims to these details, or to the figures used to illustrate the invention.

What is claimed is:

1. An LED lighting system for mounting on a predefined object such as a hat comprising:

a band attachable to the hat;

an LED module that emits multiple frequencies of light attachable to the band;

a magnetic switch and a battery mounted in the LED module:

a magnetic switching element movably mounted on the band for turning the LED module on and off.

2. The LED lighting system of claim 1 wherein the module is a sealed unit that is defined by a shell and a base plate, the shell is securely mounted on the base plate with a gasket, the shell includes a first LED that emits visible light and a second LED that emits infra red light.

3. The LED lighting system of claim 2, wherein the module includes a quiescent circuit, a magnetic reed switch and at least one coin cell battery.

4. The LED lighting system of claim 1, wherein the magnetic switching element is a magnetic ring positioned on the band associated with the LED module.

5. The LED lighting system of claim 4, wherein a stopper positioned on the band is associated with the LED module.

6. The LED lighting system of claim 4, wherein the magnetic ring has a first position and a second position.

7. The LED lighting system of claim 6, wherein the magnetic ring is in close proximity with a reed switch of the module in the first position.

8. The LED lighting system of claim 7, wherein, in the first position of the magnetic ring, the LED of the module are switched on by the magnetic effect of the magnetic ring on the magnetic reed switch in the module.

9. The LED lighting system of claim 6, wherein in the second position of the magnetic ring, the LED of the module is switched off.

10. The LED lighting system of claim 1, wherein the band is a continuous cord that is threaded through a first closed loop of the LED module and exits through a second closed loop of the LED module, the cord continuing to a snap attachment.

11. The LED lighting system of claim 2, wherein an outer surface of the base plate includes a Velcro self stick removable attachment that allows sticking the LED module to the object.

12. An LED lighting system for mounting on a predefined object such as a hat comprising:

a plurality of bands attachable to the hat;

a plurality of LED modules that emit multiple frequencies of light attachable to the band:

a magnetic switch and a battery mounted in each of the plurality of LED modules;

a magnetic switching element movably mounted on each of the plurality of bands for turning the plurality of LED modules on and off.

13. The LED lighting system of claim 12, wherein each of the modules is a sealed unit that isolates circuits in the modules from hazardous environments and is defined by a shell and a base plate, the shell is securely mounted on the base plate with a gasket, the shell includes a LED.

14. The LED lighting system of claim 12, wherein a first module and a second module are coupled with a first band and a second band.

15. The LED lighting system of claim 14, wherein the first module has a first end with a first closed loop and a second end with a second closed loop.

16. The LED lighting system of claim 15, wherein the second module has a first end with a first closed loop and a second end with a second closed loop.

17. The LED lighting system of claim 16, wherein a first end of a first band is coupled with the second closed loop of the first module and a second end of the first band is coupled with the first closed loop of the second module.

18. The LED lighting system of claim 16, wherein a first end of a second band is coupled with the first closed loop of the first module and a second end of the second band is coupled with the second closed loop of the second module.

19. The LED lighting system of claim 12, wherein each of the modules is detachable from the other modules of the light emitting system to stand alone as an attachable light source for other applications.

20. The LED lighting system of claim 1, wherein the predefined object is a helmet.

* * * * *